United States Patent [19]

Brun et al.

[11] Patent Number: 4,910,371

[45] Date of Patent: Mar. 20, 1990

[54] METHOD AND DEVICE FOR DIELECTRIC REHEATING

[76] Inventors: Eric Brun, Les Meunières St-Pancrasse, 38720 St-Hilaire de Touvet; Jean-Michel Panel, 23, rue MarQuian, 38100 Grenoble, both of France

[21] Appl. No.: 245,317

[22] PCT Filed: Nov. 24, 1987

[86] PCT No.: PCT/FR87/00461

§ 371 Date: Jul. 27, 1988

§ 102(e) Date: Jul. 27, 1988

[87] PCT Pub. No.: WO88/04127

PCT Pub. Date: Jun. 2, 1988

[30] Foreign Application Priority Data

Nov. 28, 1986 [FR] France ..... 86 16682

[51] Int. Cl.[4] ..... H05B 6/54; H05B 6/80

[52] U.S. Cl. ..... 219/10.81; 219/10.41; 219/10.55 R; 219/10.55 B; 219/10.77; 99/DIG. 14; 99/358; 426/244; 426/524

[58] Field of Search ..... 219/10.81, 10.77, 10.41, 219/10.43, 10.75, 10.55 R, 10.55 E, 10.55 M, 10.55 B; 99/DIG. 44, 451, 358; 426/234, 244, 523

[56] References Cited

U.S. PATENT DOCUMENTS

| | | | |
|---|---|---|---|
| 2,761,940 | 9/1956 | Mann | 219/10.41 |
| 2,821,611 | 1/1958 | Mann et al. | 219/10.81 X |
| 4,296,299 | 10/1981 | Stottmann et al. | 219/10.81 |
| 4,612,199 | 9/1986 | Miyahara | 99/451 X |
| 4,739,140 | 4/1988 | Reznik | 219/10.81 |
| 4,812,609 | 3/1989 | Butot | 219/10.81 |

FOREIGN PATENT DOCUMENTS

| | | |
|---|---|---|
| 0066632 | 12/1982 | European Pat. Off. . |
| 0098595 | 1/1984 | European Pat. Off. . |
| 1015548 | 10/1952 | France . |

*Primary Examiner*—Philip H. Leung

*Attorney, Agent, or Firm*—Harness, Dickey & Pierce

[57] ABSTRACT

A process for heating by dielectric hysteresis a product (11) containing at least a proportion of ice enabling to heat and/or at least to form molecules of liquid water in said product practically without heating the liquid water obtained, consisting in subjecting the product to an electric field created between two electrodes (5, 6) to which is applied an alternating voltage of a frequency having a value in the range from one kilohertz to six megahertz.

17 Claims, 2 Drawing Sheets

METHOD AND DEVICE FOR DIELECTRIC REHEATING

Figure 1:
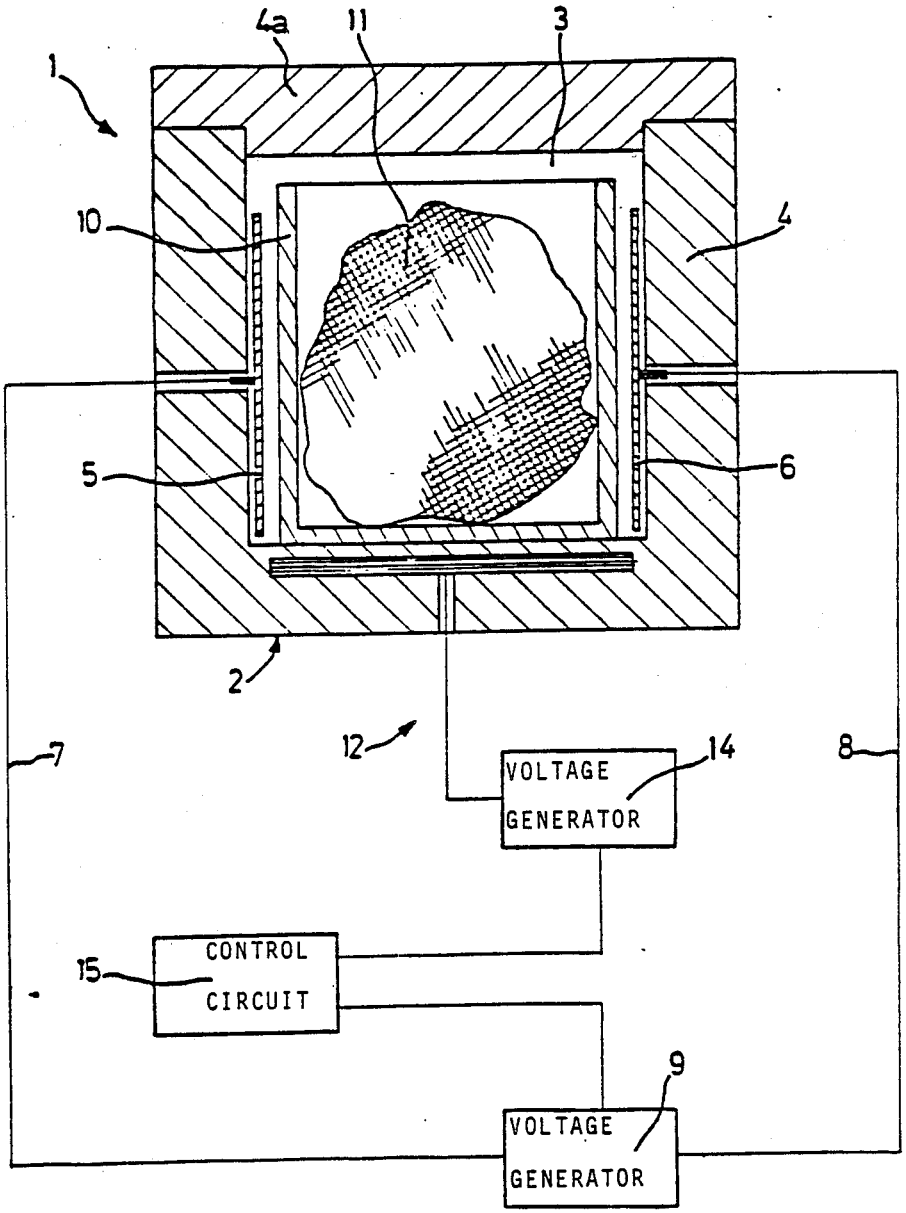

The present invention relates to a process and to a device for heating by dielectric hysteresis a product containing at least a proportion of ice.

It is nowadays quite common to heat and/or to thaw products containing at least a proportion of ice by the dielectric ultrahigh frequency heating process using a magnetron generating microwaves having a frequency of about two thousand five hundred megahertz. The practice shows however, that the effects of this dielectric ultrahigh frequency heating process are not homogeneous throughout the volume of the product and that thawing and heating of the product also occurs by conduction inside the same. Further, this known process is less effective for heating and for thawing a frozen product than for heating the thawed product, and this lack of homogeneity in the heating results in some parts of the product being hot, while others are still frozen.

The object of the present invention is in particular to remedy the deficiencies of known dielectric heating processes, and to propose a heating process by dielectric hysteresis for a product containing at least a proportion of ice, which enables to heat said frozen product and/or at least to form molecules of liquid water in said product with a controlled distribution throughout its volume or throughout a portion thereof. Further, when liquid water appears, the process causes practically no heating of the liquid water obtained, nor of the thawed portions of the product. Further, the process according to the invention allows, through the choice of its duration and/or of the voltage applied, and whatever may be the volume of the treated product, to bring the product to a determined temperature below 0° C. or to form a determined proportion of liquid water in the volume of the product.

To achieve these results, the dielectric heating process according to the present invention is such, that it consists in subjecting the product to an electric field created between two electrodes to which is applied an alternating voltage having a frequency in the range from one kilohertz to six megahertz.

According to the present invention, the frequency of the alternating voltage applied to said electrodes can advantageously be in the range from seven kilohertz to six megahertz, or in the range from twenty kilohertz to six megahertz, or in the range from seven kilohertz to one megahertz, or even in the range from twenty kilohertz to one megahertz.

The process in accordance with the present invention can advantageously comprise a step after the formation of molecules of liquid water in said product, where a second heating means in applied to the same, which second heating means can be dielectric heating with a magnetron generating ultrahigh frequencies or microwaves, the frequency of which would be, for example, above five hundred megahertz.

The process according to the present invention can advantageously consist in placing the product between two electrodes having their surfaces facing each other. In this case, the effect achieved by the process will be practically homogeneous throughout the volume comprised between these surfaces. It can also consist in placing a rodlike electrode into the product and an electrode with surfaces to face the product. In the latter case, the effect of the process will be restricted to the vicinity of the rodlike electrode.

Since the dielectric heating process according to the present invention allows the heating and/or the formation of molecules of liquid water in a frozen product to produced in a controlled manner, it can obviously be used for heating and/or thawing foodstuffs, but it can also be used for heating and/or thawing, for example partly, any frozen product such as for example snow for the purpose of studying specific phenomena.

Figure 2:
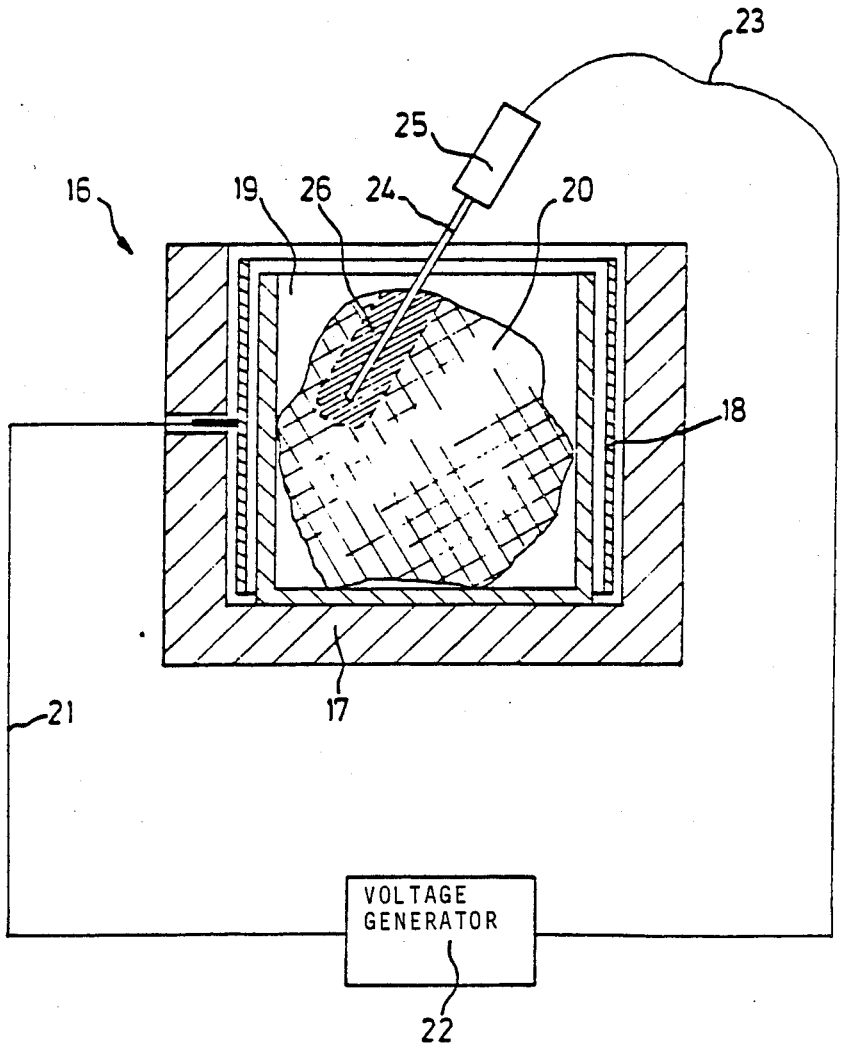

The present invention will be better understood from a consideration of non limiting examples of dielectric heating devices carrying into effect the dielectric heating process according to the present invention, which are illustrated by the drawing, where:

FIG. 1 shows a first dielectric heating device according to the present invention using flat electrodes to which is associated a second heating means; and FIG. 2 shows a second devices according to the present invention, using one cylindrical electrode and one rodlike electrode.

Referring to FIG. 1, there is shown the dielectric heating device designated generally by the reference numeral 1, which comprises an oven 2 defining an oven chamber 3, said oven 2 being of a generally parallelepipedal shape with an enclosure 4 and and access door 4a to the chamber 3, which in the example forms a lid, the walls 4 and 4a of this oven 2 being preferably made of a thermally and electrically insulating material, such as for example polyurethane.

In the oven chamber 3, and near two opposite sides perpendicular to the lid 4a, the device 1 comprises two flat parallel electrodes with a large surface area 5 and 6 made from an electrically conductive material, such as copper. These electrodes are connected through electrically conductive wires 7 and 8, which are disposed inside insulating sheaths and which extend through the walls of the oven 2, to a known alternating voltage generator 9, the construction of which does not need to be described, this alternating voltage generator 9 enabling an electric field to be produced between the electrodes 5 and 6 in the oven chamber 3.

A removable container 10 is placed at the bottom of the oven chamber 3, facing the lid 4a. This container 10 contains a frozen product 11 comprised, for example, of a lump of ice, a lump of snow, a frozen foodstuff, or any other product containing frozen water.

The device 1 as described above, functions in the following manner. The alternating voltage generator 9 applies to the electrodes 5 and 6 an alternating voltage having a frequency of a value in the range from one kilohertz to six megahertz to produce an electric field between the electrodes 5 and 6, which heats the frozen product 11 through dielectric hysteresis. When the apparatus is maintained functioning, molecules of liquid water appear in the product. The frequency band within which the value of the alternating voltage frequency applied to the electrodes 5 and 6 is selected is such that heating and, if required, thawing occur thoughout the entire volume of the product to be thawed 11 in a substantially homogeneous manner, and also such that the thawed portions of the product 11 remain substantially unheated, so that a complete thawing of the product 11 can be achieved without the latter undergoing any localized heating in its thawed portions, while other portions would have remained frozen.

Said frequency band extends from one kilohertz to six megahertz, and it can be particularly advantageous to choose a frequency value for the alternating voltage applied to the electrodes 5 and 6 in the range from seven kilohertz to six megahertz, in the range from twenty kilohertz to six megahertz, in the range from seven kilohertz to one megahertz or even in the range from twenty kilohertz to one megahertz.

The device 1 shown in FIG. 1 further comprises an additional heating means, which in the example is a known dielectric heating means using microwaves, designated generally by the reference numeral 12 and placed in the wall, and an alternating voltage generated 14 providing an alternating voltage having a frequency above five hundred megahertz and, preferably, in the vicinity of two thousand five hundred megahertz, in order to achieve the heating of the product 11 by microwaves.

The voltage generators 9 and 14 are connected to a control circuit 15 which is capable of operating the device 1 as described hereunder and does not need to be described.

First, the control circuit 15 actuates the alternating voltage generator 9. As was explained previously, the electric field created between the electrodes 5 and 6 heats the frozen product 11 and causes molecules of liquid water to appear, which are distributed throughout its entire volume.

Either after a predetermined period of time, or through the measure of the temperature of the product being thawed 11, when a sufficient quantity of molecules of liquid water has formed in said product or when the product 11 is completely thawed, the control circuit 15 can switch off the alternating voltage generator 9 and switch on the second heating means 12, which is designed for heating a product containing at least a proportion of liquid water.

Referring to FIG. 2, there is shown a dielectric heating device designated generally by reference numeral 16, which comprises an enclosure 17 having a cylidrical horizontal cross-section, which is made of a thermally and electrically insulating material such as, for example, polyurethane. In this enclosure 17, there is provided in the vicinity of the inner cylindrical wall, an electrode 18 having an annular horizontal cross-section. Surrounded by this cylindrical electrode and placed upon the bottom of the enclosure 17, there is provided a removable container 19 into which is disposed a frozen product 20.

The cylindrical electrode 18 is connected through a wire 21 disposed inside an insulating sheath to an alternating voltage generator 22 which is also connected through a wire 23 disposed inside an insulating sheath to a second rodlike electrode 24 protruding from an insulated handle 25, this rodlike electrode 24 being driven into the product to be thawed 20.

The device 16 shown in FIG. 2 formed by the two electrodes 18 and 24 and the alternating voltage generator 22 functions in the same manner as the device 1 shown in FIG. 1 consiting of the two electrodes 5 and 6 and of the alternating voltage generator 9.

However, in the example of FIG. 2, the electric field which is produced in the product to be thawed 20 is particularly effective around the rodlike electrode 24, for example in the portion 26 defined in FIG. 2.

As previously, the product being thawed 20 is heated in this portion 26 and, if the device is kept functionning, molecules of liquid water appear without the liquid water which forms being heated. In particular, it is possible to achieve a partial thawing of the product 20 in the portion 26, and the thawed portion 26 can be removed for further processing.

The present invention is not limited to the examples described hereabove. There are many versions through which the invention can be carried into effect without departing from the scope of the invention defined in the claims.

We claim:

1. A process of heating a product by dielectric hysteresis when said product contains at least a portion of ice, said heating process comprising the steps of:

providing two electrodes;

providing an alternating voltage generator electrically connected to said electrodes;

applying an alternating voltage to said electrodes to create an electric field between said electrodes;

subjecting said product to said electric field; and controlling the frequency of said alternating voltage so that said ice within said product forms liquid water and thaws said product without further heating said thawed product or liquid water.

2. The process according to claim 1, wherein the frequency of said alternating voltage is in a range of between one kilohertz and six megahertz.

3. The process according to claim 1, wherein the frequency of said alternating voltage is in a range of between twenty kilohertz and six megahertz.

4. The process according to claim 1, wherein the frequency of said alternating voltage is in a range of between seven kilohertz and one megahertz.

5. The process according to claim 1, wherein the frequency of said alternating voltage is in a range of between twenty kilohertz and one megahertz.

6. The process according to claim 1, further comprising the step of applying a second heating means to said product to heat said product.

7. The process according to claim 6, further comprising the step of providing a control circuit electrically connected to said alternating voltage generator and said second heating means

8. A heating device for thawing a product by dielectric hysteresis when said product contains at least a portion of ice, said heating device comprising:

a plurality of electrodes;

an alternating current generator providing said electrodes with alternating voltage to create an electric field between said electrodes; and means for controlling the frequency of said alternating voltage between one kilohertz and six megahertz to cause said ice to form liquid water within said product and thaw said product without further heating said liquid water or said product.

9. The heating device according to claim 8, wherein said electrodes are located within an oven having walls which define an oven chamber.

10. The heating device according to claim 9, wherein said oven walls are made of a thermally and electrically insulating material.

11. The heating device according to claim 9, wherein said electrodes comprise two flat parallel electrodes located within said oven chamber.

12. The heating device according to claim 11, wherein said electrodes are electrically connected to said generator through wires disposed inside insulating sheaths extending through said oven walls.

13. The heating device according to claim 9, further comprising a removable container located in said oven chamber.

14. The heating device according to claim 8, further comprising a second heating means located within said oven for heating said product.

15. The device according to claim 14, wherein said second heating means uses microwaves to heat said product.

16. The device according to claim 14, wherein said alternating voltage generator and said second heating means are electrically connected to a control circuit.

17. The device according to claim 8, wherein said electrodes comprise an electrode with an annular horizontal cross-section disposed within an insulating sheath within said oven and a rod-like electrode protruding from an insulated handle, said rod-like electrode located within said product.

* * * * *

UNITED STATES PATENT AND TRADEMARK OFFICE

CERTIFICATE OF CORRECTION

PATENT NO. : 4,910,371

DATED : March 20, 1990

INVENTOR(S) : Brun, et al.

It is certified that error appears in the above-identified patent and that said Letters Patent is hereby corrected as shown below:

On the title page, the following assignment data should be inserted:

--L'Etat Francais Ministère Délégué aux Transports, BOULOGNE-BILLANCOURT CEDEX, FRANCE--.

Col. 1, line 56, "in" should be --is--;

Col. 2, line 6, "produced" should be --proceed--;

Col. 2, line 19, "devices" should be --device--;

Col. 2, lines 60,61, "product to be thawed 11" should be --product 11 to be thawed--;

Col. 3, line 11, "generated" should be --generator--;

Col. 3, lines 28,29, "product being thawed 11" should be --product 11 being thawed--;

Col. 3, line 38, "cylidrical" should be --cylindrical--;

Col. 3, line 53, "product to be thawed 20" should be --product 20 to be thawed--;

UNITED STATES PATENT AND TRADEMARK OFFICE

CERTIFICATE OF CORRECTION

PATENT NO. : 4,910,371

DATED : March 20, 1990

INVENTOR(S) : Brun, et al.

It is certified that error appears in the above-identified patent and that said Letters Patent is hereby corrected as shown below:

Col. 3, line 57, "consiting" should be --consisting--;

Col. 3, line 60, "product to be thawed 20" should be --product 20 to be thawed--;

Col. 3, line 63, "product being thawed 20" should be --product 20 being thawed--;

Col. 3, line 64, "functionning" should be --functioning--;

Col. 4, line 40, After "means", insert --.--.

Signed and Sealed this

Ninth Day of June, 1992

*Attest:*

DOUGLAS B. COMER

*Attesting Officer*

*Acting Commissioner of Patents and Trademarks*